US010110993B1

(12) United States Patent
Heebner et al.

(10) Patent No.: US 10,110,993 B1
(45) Date of Patent: Oct. 23, 2018

(54) HIGH-POWER ELECTRONIC OMNIDIRECTIONAL SPEAKER ARRAY

(71) Applicant: ATI SYSTEMS, INC., Boston, MA (US)

(72) Inventors: Jonathan Heebner, Boston, MA (US); Ray Bassouni, Boston, MA (US); Kevin Cassidy, Boston, MA (US)

( * ) Notice: Subject to any disclaimer, the term of this patent is extended or adjusted under 35 U.S.C. 154(b) by 0 days.

(21) Appl. No.: 14/957,560

(22) Filed: Dec. 2, 2015

(51) Int. Cl.
*H04R 1/30* (2006.01)
*H04R 1/40* (2006.01)
*H04R 3/12* (2006.01)

(52) U.S. Cl.
CPC ..... *H04R 1/403* (2013.01); *H04R 1/30* (2013.01); *H04R 3/12* (2013.01); *H04R 2400/13* (2013.01)

(58) Field of Classification Search
CPC ..... H04R 1/30; H04R 1/403; H04R 2400/13; H04R 27/00; G10K 11/025
See application file for complete search history.

(56) References Cited

U.S. PATENT DOCUMENTS 4,878,561 A * 11/1989 Tengstrand ..... H04R 1/403 181/144
4,882,562 A * 11/1989 Andrews ..... H04R 1/30 181/185
4,908,601 A * 3/1990 Howze ..... G08B 3/00 181/144
5,146,508 A * 9/1992 Bader ..... G10K 11/025 381/152
5,321,388 A * 6/1994 Biersach ..... G10K 11/025 181/142
7,360,499 B1 * 4/2008 O'Neill ..... B63B 45/04 116/137 R
9,111,521 B2 * 8/2015 Blore ..... G10K 11/025 381/117
9,185,476 B2 * 11/2015 Ickler ..... G10K 11/025
2016/0088387 A1 * 3/2016 LaCarrubba ..... G10K 11/28 381/340

* cited by examiner

*Primary Examiner* — Matthew Eason

(57) ABSTRACT

A high-power omnidirectional electronic speaker array (or "siren") having a variable number of circular chambers vertically arranged on a rigid mast. Each chamber, or module, contains one or more manifolds that serve as waveguides for the sound energy emanating from audio compression drivers. Each manifold combines the output of two or more compression drivers into a single source, and maintains a smoothly and exponentially increasing cross-sectional area for the full length of the waveguide to an output port located close to the center of the module. The curved external surfaces of the upper and lower sections of adjacent modules continue the exponentially-increasing cross-sectional area to create a horn-shaped final output mouth for the sound energy. The separation between vertically adjacent exiting surfaces of multiple modules is minimized for the purpose of improved intelligibility, maximum acoustic range, and lower distortion.

8 Claims, 7 Drawing Sheets

HIGH-POWER ELECTRONIC OMNIDIRECTIONAL SPEAKER ARRAY

BACKGROUND

There are several versions of omnidirectional outdoor sirens which consist of multiple stacked circular speaker arrays, or cells. These designs were generally developed decades ago. Each type of design has certain advantages, yet also certain disadvantages, such that a new improved siren can be developed as provided herein that incorporates some of the advantages, eliminates the disadvantages, and introduces new enhancements to performance, manufacturability, and serviceability.

Omnidirectional modular sirens have been available through companies such companies as Whelen Engineering, Federal Signal, and American Signal. The existing designs from each of these companies generally consist of one or more disc-shaped modules that stack vertically, within which there is one or more audio compression drivers which output sound energy directed through an expanding channel that then exits through either its lower and/or upper surface where the sound energy then spreads out omnidirectionally in the horn-shaped space between the modules.

Whelen's U.S. Pat. No. 4,908,601 describes a single, very powerful and therefore heavy and expensive 400 watt driver mounted vertically in each module. Due to the high percentage of total siren output provided by each driver, the failure of one driver can result in a measurable and noticeable degradation of siren output. Because the weight of the driver is over 10 pounds and is centrally located on a 30" diameter structure, it is also very difficult to service.

The Whelen design is in the radial support structure of the stacking methodology. A series of 6 vertical support posts secured by nuts and bolts are positioned around the peripheral edge of each module, creating the supporting structure and strength of the stack of multiple modules. Six vertically oriented nuts and bolts are used to secure the posts of adjacent modules. Being vertically positioned, the bolts are difficult to access and require using two tools (bolt and nut end) at the same time to remove or install. The support posts are also positioned in the exiting acoustic surface, presenting multiple discontinuities in the acoustic wavefront path in all directions Another disadvantage of the Whelen design is regarding the total length and shape of the acoustic channel (horn shape) that directs the sound energy. The Whelen design provides a horn channel that is only approximately 26" long measured from the throat of the channel where sound enters from the driver, to the mouth of the exiting surface between the modules, which is considerably shorter than other siren designs. In addition, the parabolic and radically flared shape of the Whelen design in the final exiting surface represents a significant change (discontinuity) in the rate of expansion of the cross-sectional area of the sound energy wavefront as it transitions from the vertical tubes to the omnidirectional area between cells.

Federal Signal's U.S. Pat. No. 5,146,508 utilizes a single central mast, to which one or more stackable modules can be attached. Each module contains 4 independent acoustic waveguides (horn manifolds) that each use a single 100 watt compression driver. The sound energy travels from each driver, through its respective manifold, and is then directed downward to an opening in the module near the center mast. The sound energy enters the space between the modules and then reflects off of a conical shape near the center to radiate outward omnidirectionally.

A third omnidirectional siren design is presented is American Signal's U.S. Pat. No. 5,321,388. This patent presents a siren design which combines multiple drivers into a manifold that then splits the sound energy such that it travels into separate upper and lower exiting compartmental sections that are vertically adjacent and thereby diluting rather than concentrating or nullifying the sound. The sections are also physically limited by vertical spacers to a specific quadrant of the targeted local omnidirectional area. This design is more appropriate for applications that may require only one, two, or three quadrants of sound. In addition, the vertically-split sound manifold results in a mechanical structure that is more difficult to assemble and to service in the field when compared to designs that maintain single-level audio modules that are not linked vertically.

SUMMARY OF INVENTION

Modular omnidirectional electronic sirens as provided herein incorporate several significant improvements that affect performance, ease of servicing, and manufacturability.

An associated purpose of one or more aspects of the invention is to provide an improved siren having a sound wave path that has an exponentially increasing cross sectional area consistent over its entire length.

An additional purpose of one or more aspects of the invention is to provide an improved siren having the ability to use either one or two compression drivers for each audio waveguide (manifold).

A further purpose of one or more aspects of the invention is to provide an improved siren whereby each individual manifold covers 180 degrees of the omnidirectional sound output, thus minimizing the numbers of manifolds or wave guides.

Another purpose of one or more aspects of the invention is to provide an improved siren that maximizes the vertical size of each horn mouth and minimizes the vertical space between adjacent horn mouths.

An additional purpose of one or more aspects of the invention is to provide an improved siren with better low-frequency performance for longer range.

A further purpose of one or more aspects of the invention is to provide an improved siren with better frequency characteristics for enhanced voice intelligibility.

One purpose of one or more aspects of the invention is to provide a siren comprising having one or more vertically stacked modules that have first and second radially opposed manifolds housed within the module. The manifolds can have equal cross-sectional area interior surfaces defining waveguides and the manifolds further having distal opposing half-annular openings which are operable to combine the sound emitted by the opposing half-annular opening. The siren further includes two or more in-phase sound drivers coupled to a proximal throat portion of each said manifold and a lower waveguide connected to the half-annular openings presenting a circumferential outlet that has an exponentially increasing surface area formed between an outer surface of said module and an adjacent opposing surface or module.

DESCRIPTION OF THE PREFERRED EMBODIMENTS

As described in the Background, there exists a need for a modular omnidirectional electronic siren incorporating several significant improvements that affect performance, ease of servicing, and manufacturability.

Unlike presently available omnidirectional sirens the present invention includes horns with an interior waveguide surface that is defined by a smoothly-increasing (exponentially) cross-sectional area with minimal or no sharp changes, angles or discontinuities. Such designs importantly do not give rise to sudden changes in the rate of expansion of the wavefront area in the output section of the horn and which can increases distortion and causes varying attenuation based on frequency and therefore lower the intelligibility of voice audio that the siren can produce. The prior art teaches essentially flat conical surfaces used to reflect the sound energy outward horizontally as it enters the space between modules, the overall path of the sound energy is therefore does not maintain a smoothly increasing cross-sectional area. Accordingly, the conical section in the transitional area of the wavefront's directional path represents a discontinuity in the expansion of the wavefront cross-sectional area, which is hyperbolic within the manifolds, and then transitions to conical, and finally becomes hyperbolic again in the final mouth area. The present invention improves this design by adjusting the shape of each section to maintain a consistent and smooth exponentially increasing cross-sectional area throughout the entire wavepath, therefore reducing discontinuities that cause acoustic impedances that lead to performance degradation The description of the preferred embodiment of the present invention is intended to cover any and all alternatives, adjustments, and modifications as would be considered related and equivalent to the details described by the included claims.

Figure 1:
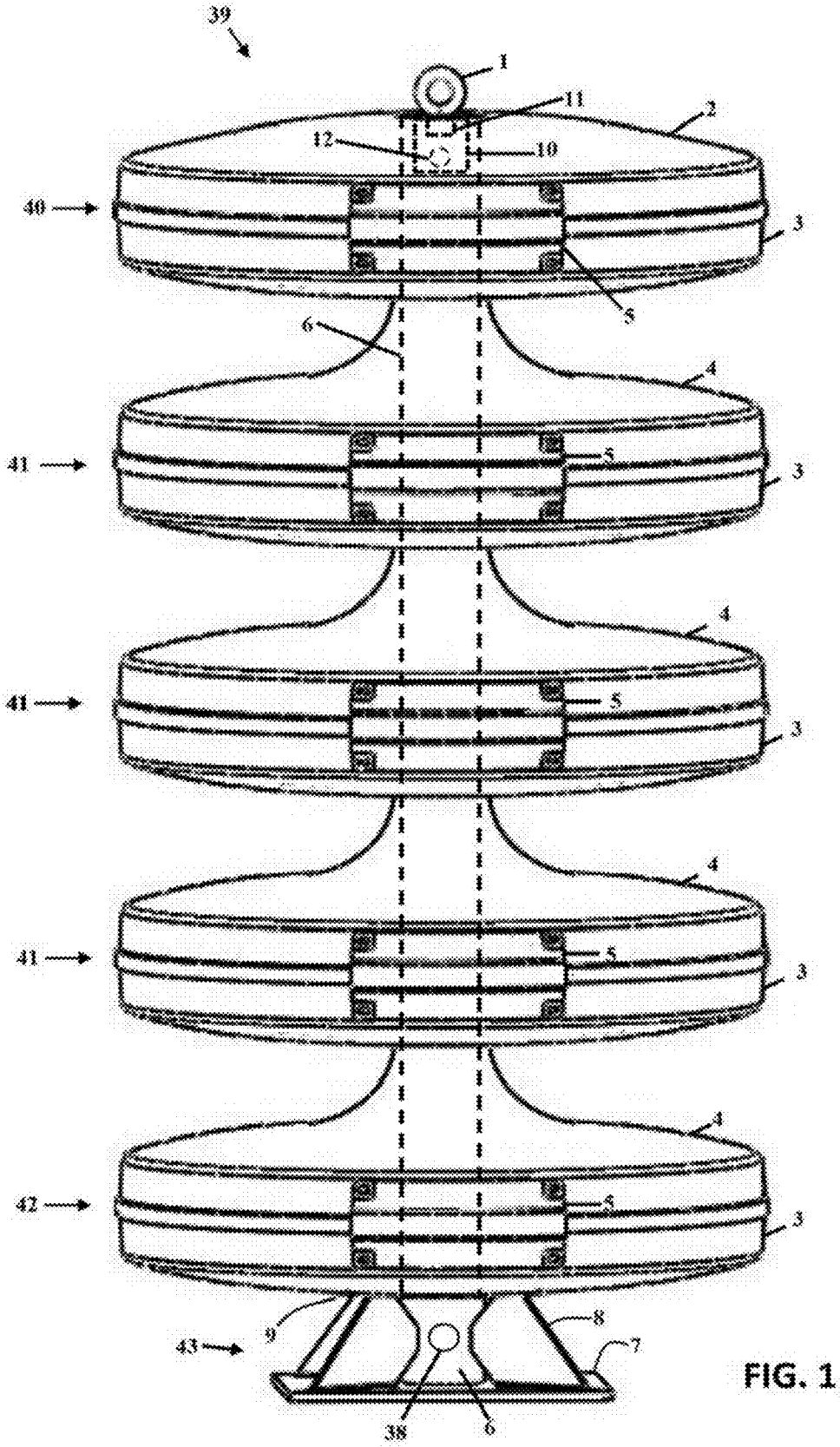
FIG. 1 is a full side profile view of a modular siren representing of one or more aspects of the invention.
Figure 2:
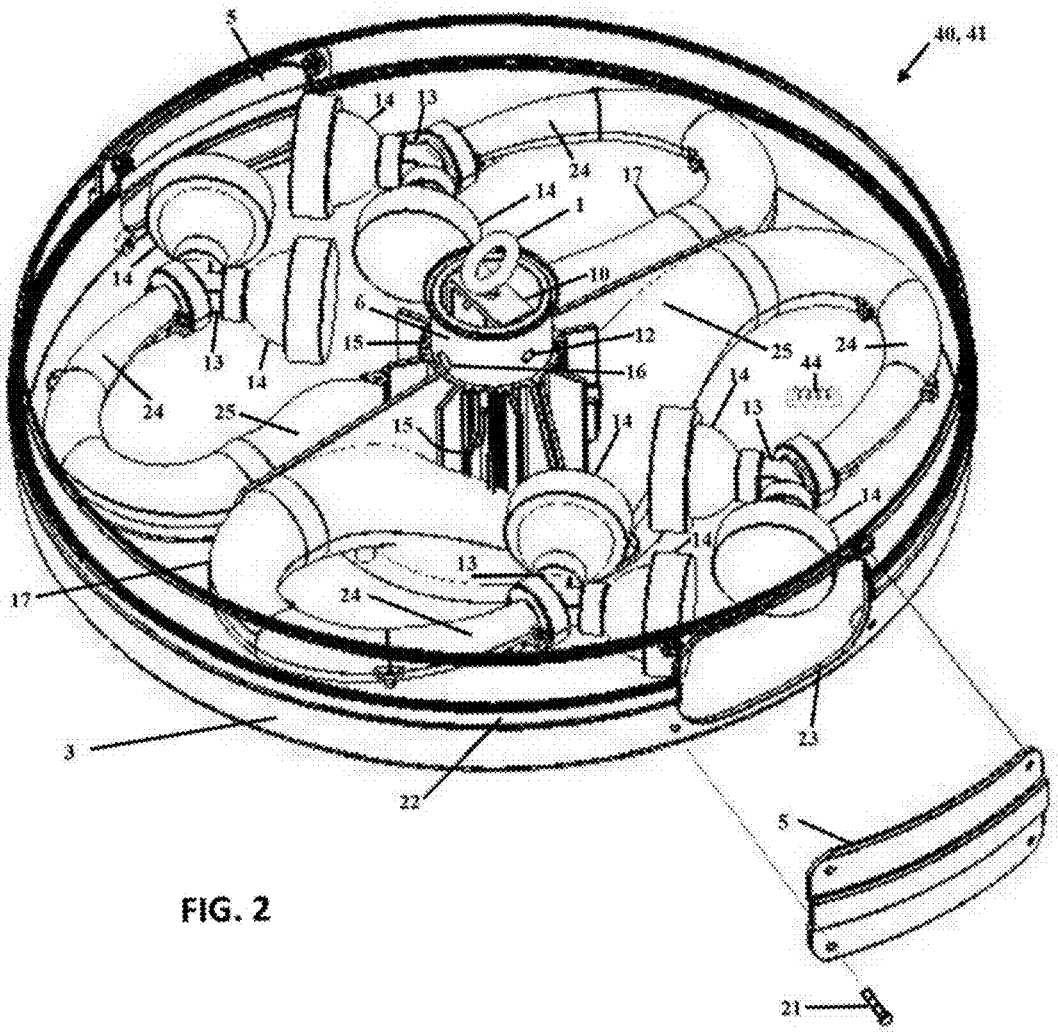
FIG. 2 is a cross-sectional perspective view of the top module in the siren of FIG. 1, displaying the component layout of manifolds and drivers within an exemplary module.

Starting with FIG. 1, shown is a fully assembled modular omnidirectional electronic siren 39 constructed in accordance with one or more aspects of the invention. FIG. 2 shows the internal components and layout of a typical active module 40 or 41. The basic construction of one or more aspects of the invention is to form a plurality of vertically stacked audio horns. An audio horn in its simplest form is a partially enclosed structure with a smaller opening called the throat for the audio input source, and a larger opening called the mouth for the output of sound at the other end. In one aspect of the present invention, the path of the sound energy moves from the drivers 14, into the manifold 17 and then out into the exponentially increasing space between modules, which forms the basic structure of an audio horn. At the very end of each manifold tube 24, there is an opening 34 that forms the initial entry of audio energy from the drivers 14, and this opening 34 functions as the throat of the horn. The shape of the interior of the two tubes 24 in the manifold 17 are specifically designed to have an exponentially increasing cross-sectional area. The two tubes 24 meet and combine into one space at location 25, where the initial internal cross-sectional area of the combined space is equal to the sum of the final cross-sectional areas of the two tubes 24 at their meeting point. The shape of the combined section 25 also increases its cross-sectional area exponentially from the point at where the two tubes 24 meet, until the half-annulus output port 29.

Turning back to FIG. 1, the siren 39 is built of multiple enclosed modules that are arranged vertically and affixed to a central rigid mast 6 with a bottom base plate 7 and a steel lifting hook 1 at the top. The top module 40 and lower modules 41 are constructed as active modules that contain components that can output sound, and the lowermost or bottom module 42 is inactive, being devoid of active components. An assembled siren 39 consists of one active top module 40, a variable number of active modules 41 from one to seven depending on the application need, and one bottom module 42. Each active module's enclosure assembly 41 is constructed of an upper half-shell 4, or upper half-shell 2 for the top module enclosure assembly 40, and a lower half-shell 3. The module enclosures 40, 41, and 42 may be made of either aluminum or a form of plastic such as ABS or polycarbonate. Each active module 40 and 41 are secured in the mast 6, this method of securement is described in the following sections. The base plate mounting assembly 43 consists of a square base plate 7 with angled support plates 8 and an upper circular plate 9 that are all welded together with the mast 6, and that may be constructed of either aluminum or steel. The bottom inactive module 42 is secured with nuts and bolts to the circular plate 9 that is part of the base plate mounting assembly 43. The lifting hook 1 is an eye-bolt that goes through a small hole in the upper half-shell 2 of the top module 40, and screws into a welded nut 11 that is affixed to an internal bracket 10. By bolting this bracket 10 thru a hole in the mast 6 at location 12, the lifting hook 1 becomes solidly affixed to the entire structure of the siren assembly 39. To allow service access to the internal components of each active module 40 and 41, there are two easily removed access panels 5 on opposite sides of each module.

Figure 5:
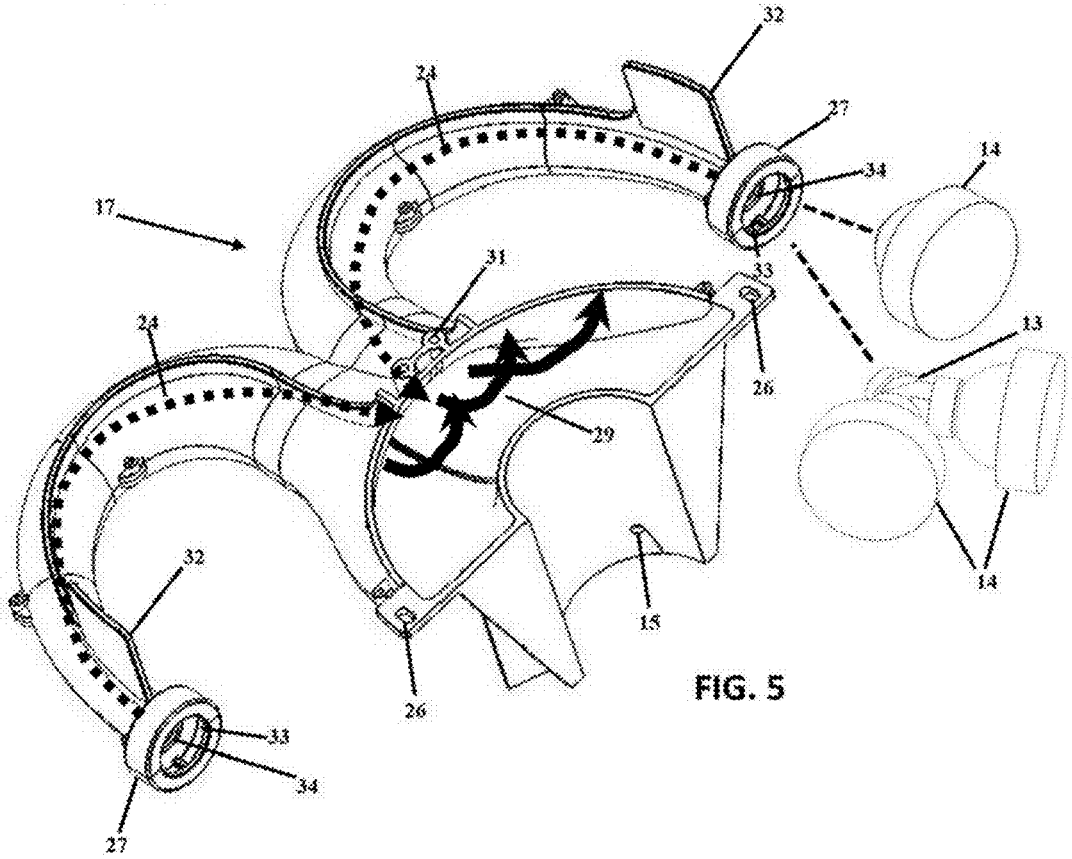
FIG. 5 is a perspective view of the driver manifold as shown in FIG. 4 from below, including driver options, i.e. a single or including and adapter for 2 or more compressors. Though the "arrows" indicating the wavepath seem to point upward in the figure, in this embodiment they extend and radiate downward between that module and the lower adjacent module though in practice this can be reversed.
Figure 6:
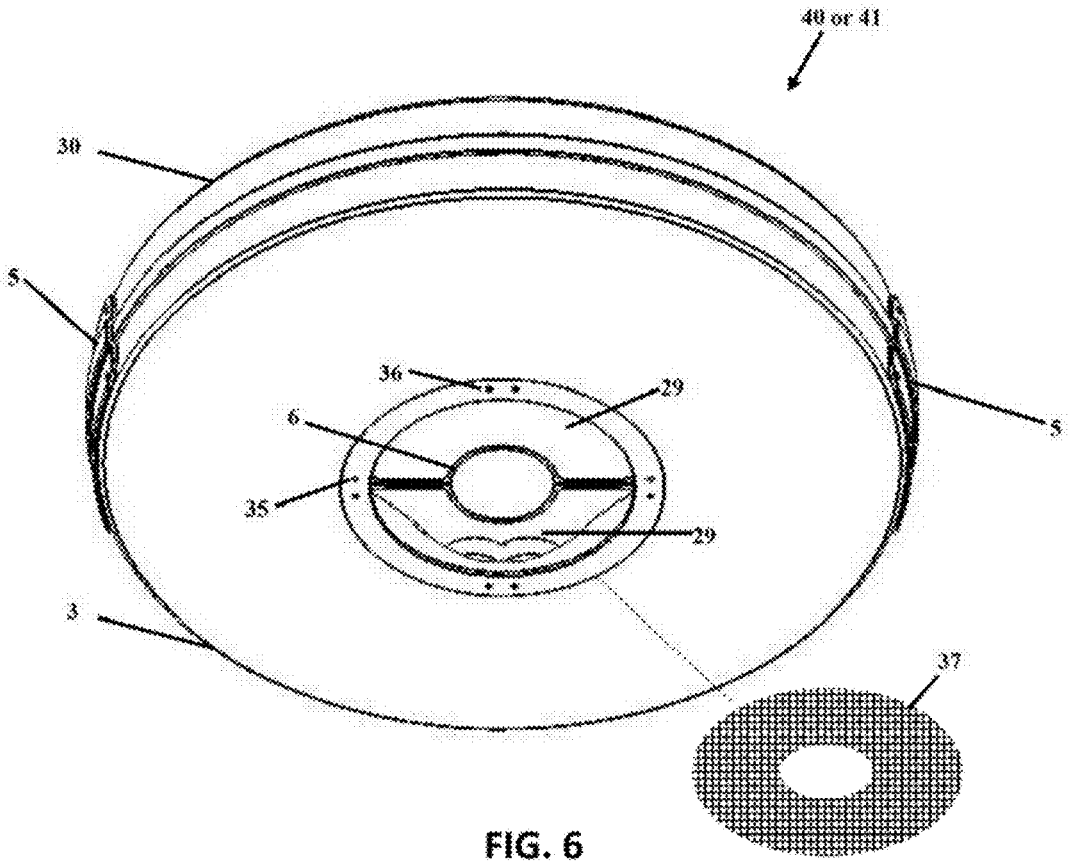
FIG. 6 is a perspective view showing the bottom of a typical module assembly as shown in FIG. 3 illustrating the downward and omnidirectional sound output port created by the two manifolds contained in a module.

Moving on to FIG. 2, shown are the internal components and layout of a typical active module 40 or 41, each containing either one or two manifolds 17 constructed of plastic such as ABS or polycarbonate. The manifolds 17 act as a waveguide for the sound energy emanating from the 100-watt audio compression drivers 14, routing and directing the sound from the drivers 14 to the output port 29, as described in more detail in a following section. Each manifold 17 has two long curved tubes 24 that come together and merge in location 25, where the shape then spreads out into a larger area and curves downward to form a semi-circular output port 29 next to the mast 6, as shown in FIG. 5 and FIG. 6. At the narrow end of each of the two manifold 17 tubes 24, is shown an attached Y-adapter 13 and two 100-watt compression drivers 14. This method allows a total of four drivers 14 per manifold 17, and eight drivers 14 maximum per active module 40 or 41, for a maximum total of eight hundred watts per active module 40 or 41 using two manifolds 17. Alternatively and depending on the application, as shown in FIG. 5, each manifold 17 can be used with a single 100-watt driver 14 at the end of each tube 27, for a total of two hundred watts per manifold 17, and a maximum total of four hundred watts per active module 40 or 41, using two manifolds 17. Each manifold 17 is secured to the central mast 6 at two locations 15 by a bolt with a heavy square washer. Each active module 40 or 41 may contain either one manifold 17 for 180 degree sound coverage or two manifolds 17 for 360 degree sound coverage, depending on the application.

For ease of access to the drivers 14 and their electrical connections for replacement or servicing purposes, there are two access panels 5 on opposite sides of each active module 40 or 41, located near to the positioning of the drivers 14. Each access panel 5 is easily removable with four screws using standard tools.

Each active module 40 or 41 has connected wiring from the input terminals of the audio compression drivers 14 to a terminal block 44 located on the lower half-shell 3, then from the terminal block 44 the wiring is routed thru a hole at location 16 on the mast 6, downward thru the mast 6, and out the hole at location 38 at the bottom of the mast 6 shown on FIG. 1. From there, the wiring will be connected to an external remote audio amplifier that is separate and not part of the present invention.

Figure 3:
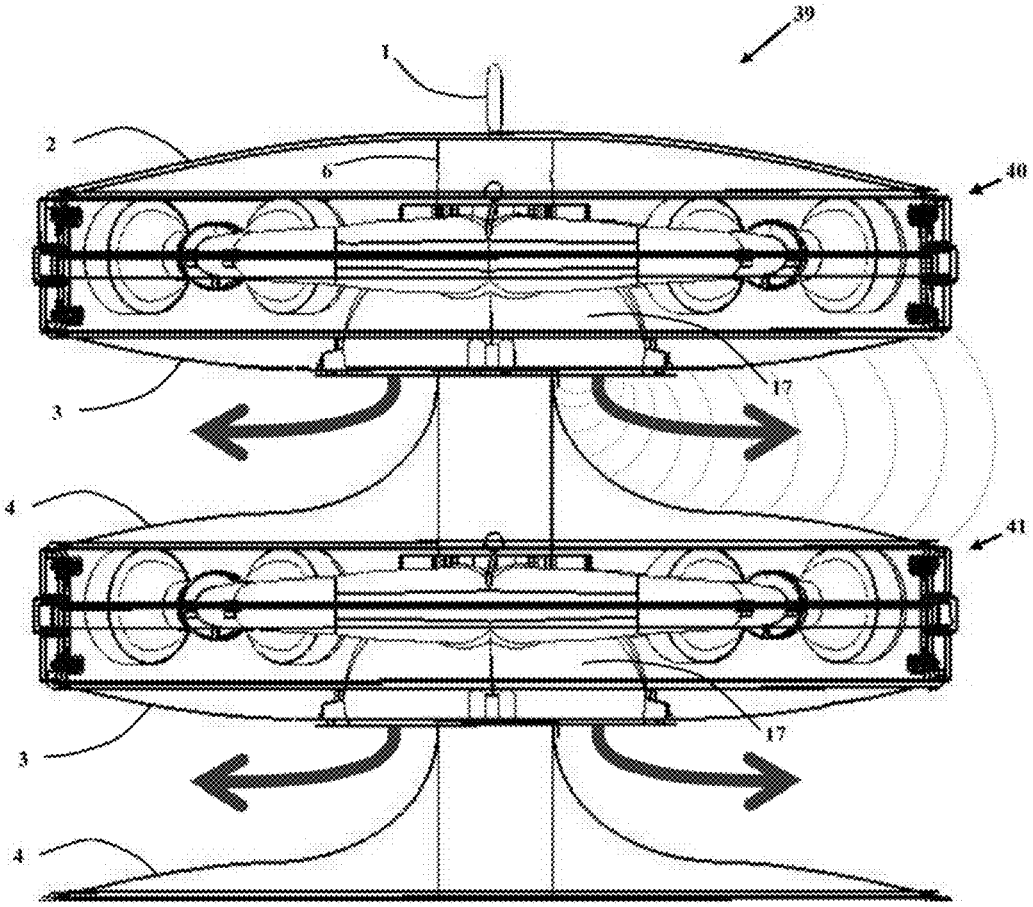
FIG. 3 is a cross-sectional side view of the top and a vertically adjacent module from the siren of FIG. 1, illustrating directional output of sound energy between modules and the shape of the horn mouth for an exemplary siren configuration.

FIG. 3 shows an example of the functional nature of the active modules, showing an active top module 40 and an active module 41 vertically positioned on the mast 6 below the top module 40. This example can be extrapolated to any number of additional active modules 41 from one to seven as needed, based on the application's audio output and coverage requirements. Examining the shape of the space between each vertically adjacent pair of modules 40, 41, and 42, it is seen that the lower half-shell 3 of the upper module and the upper half-shell 4 of the lower module forms an expanding horn-like shape. As described in the section above regarding FIG. 2, within each active module 40 or 41 the audio energy from the 100-watt compression drivers 14 is directed thru the manifolds 17 to the downward output port at locution 29 near the center of the siren 39. When this audio energy's wavefront enters the space between vertically adjacent modules from the output port 29 of the upper active module 40 or 41, it will be directed outward horizontally, then expand out radially and omnidirectionally in a space that has an exponentially-increasing cross-sectional area as described in FIG. 7, and as shown in FIG. 3. The height of the opening between modules at the peripheral edge, considered the month of the horn, is approximately 8.85 inches. The height of the module itself, representing the space between each horn mouth, is approximately or about 5 inches. Therefore the ratio of the height of the mouth to the space between mouths is 8.85/5=1.77.

As was stated earlier, another area of improvement according to an aspect of the invention is in optimizing the vertical spacing of the adjacent modules. The stacking of modules vertically creates essentially an acoustical Vertical Line Array, or VLA. To maximize the acoustic performance of a VLA in terms of distortion and directionality, the space between horn mouths should be minimized, and the ratio of the height of the mouth to the height of the space between them should be maximized. This characteristic of a VLA affects the ability of the multiple vertical sources to combine efficiently, affecting the range und distortion qualities of the audio output. In one commercially available design (not shown), the height of the exiting space between modules (the mouth of the horn shape) is approximately 8", while the height of the edge of the module itself, which represents the "dead" space between horn mouths, is 5.5". This represents a ratio that is 8/5.5=1.455. By adjusting the exponential shape of the exiting surface and the shape of the modules themselves as according to one aspect of an embodiment of the invention (as in the preceding paragraph), it would possible to improve this ratio to approximately 1.7, an increase of 16.8%. In certain other embodiments the distance between modules has been reduced to between approximately or about 1 and 5 inches.

Figure 4:
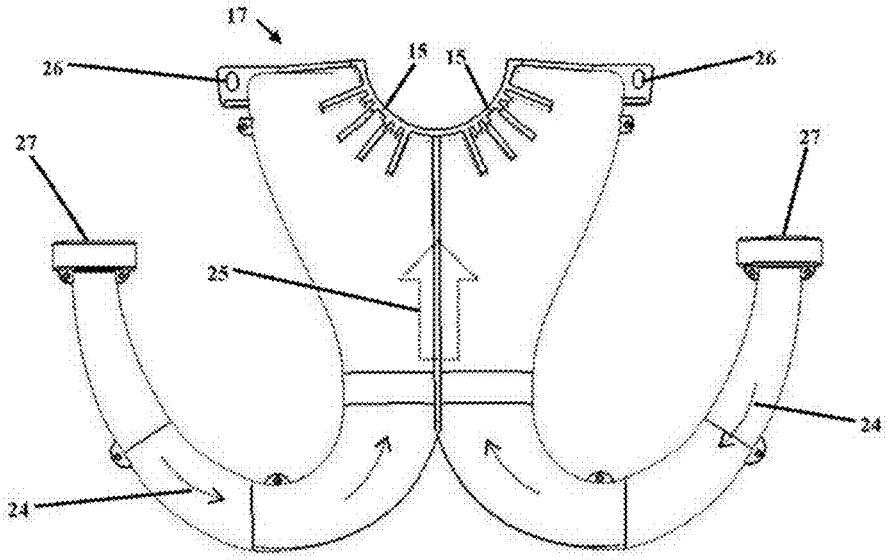
FIG. 4 is a cross-sectional top view of the driver manifold of FIG. 2 of one or more aspects of the invention. Also shown here and in other accompanying figures is the direction of the sound energy wavepath (shown as a "dotted-lines and arrows.")

Moving on to FIG. 4 and FIG. 5, shown is a top view and bottom view of the manifold 17. Each manifold 17 has two long curved slowly expanding tubes 24 that combine into one expanding channel 25, then turns downward into a final opening port 29 in the shape of a half-annulus where it rests against and is bolted to, the mast 6 at two locations 15. To secure each manifold to the lower half-shell 4 of the active module 40 or 41 that it is contained within, it is additionally bolted at four locations 26 and 31. These securements of the manifold 17 to the lower half-shell 4 also provides the overall support for the module enclosure 40 or 41, because the manifold is secured to the mast 6 as previously described. At the end of each manifold tube 24, there is a collar 27 and metal threaded insert 33 for attaching the drivers 14 or Y-adapter 13, as previously described.

The basic construction of the invention is to form a plurality of vertically stacked audio horns. An audio horn in its simplest form is a partially enclosed structure with a smaller opening called the throat for the audio input source, and a larger opening called the mouth for the output of sound at the other end. In the present invention, the path of the sound energy moves from the drivers 14, into the manifold 17 and then out into the exponentially increasing space between modules, which forms the basic structure of an audio horn. At the very end of each manifold tube 24, there is an opening 34 that forms the initial entry of audio energy from the drivers 14, and this opening 34 functions as the throat of the horn. The shape of the two tubes 24 in the manifold 17 are specifically designed to have an exponentially increasing cross-sectional area. The two tubes 24 meet and combine into one space at location 25, where the initial cross-sectional area of the combined space is equal to the sum of the final cross-sectional areas of the two tubes 24 at their meeting point. The shape of the combined section 25 also increases its cross-sectional area exponentially from the point at where the two tubes 24 meet, until the half-annulus output port 29.

In FIG. 6, shown is a bottom angled view of a typical active module 40 or 41. The two half-annulus output ports 29 is where the sound energy is output from the two manifolds 17 contained within the module. Locations 35 and 36 represent the bolt locations for attaching the lower half-shelf 3 to the manifolds 17 at locations 26 and 31, as seen in FIG. 5. To prevent entry of insects and other pests from the openings 29 at the bottom of the active modules 40 and 41, a screen mesh is inserted between the manifolds 17 and the lower half-shell 3, held in place by the securement of the components it is between and additional adhesives or sealants as needed.

Figure 7:
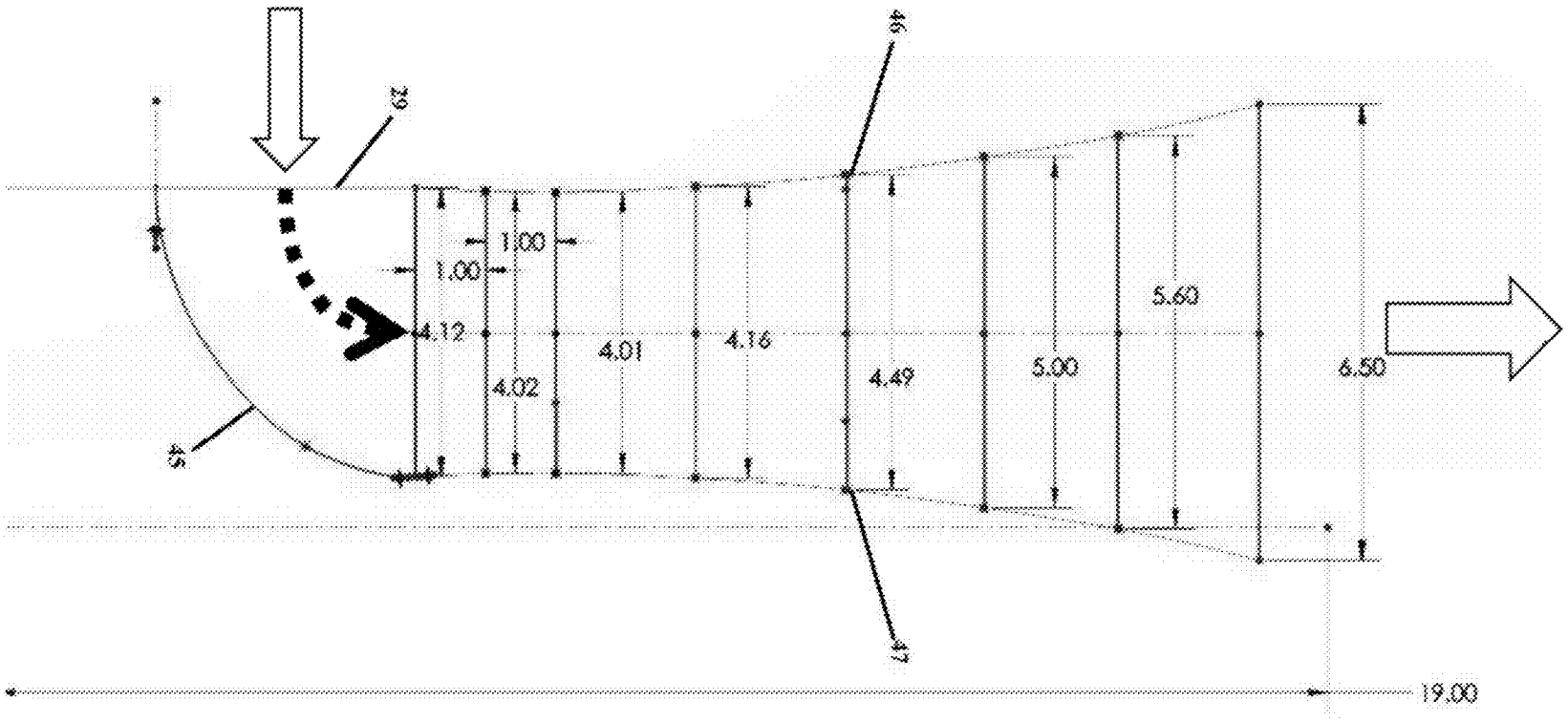
FIG. 7 is a cross-sectional view illustrating the open space between one variation of modules according to one or more aspects of the invention, where the sound energy is redirected for broadcast omnidirectionally out into free air or other medium.

In FIG. 7 is shown the shape of the expanding open space between each lower half-shell 3 of an active module 40 or 41, and the upper half-shell 4 of the module below it. As illustrated, the audio energy exits the active module 40 or 41 at the half-annulus output port 29 near the center of the structure, and enters the described space. The slope 48 of the upper half-shell 4 smoothly redirects the audio energy from vertical to an outward horizontal directionality. As the sound travels outward from the center toward the perimeter of the siren structure 29, the shape of the space between the modules created by the lower and upper surfaces of the modules creates a space of exponentially increasing cross-sectional area for the expanding omnidirectional acoustic wavefront.

Figure 8:
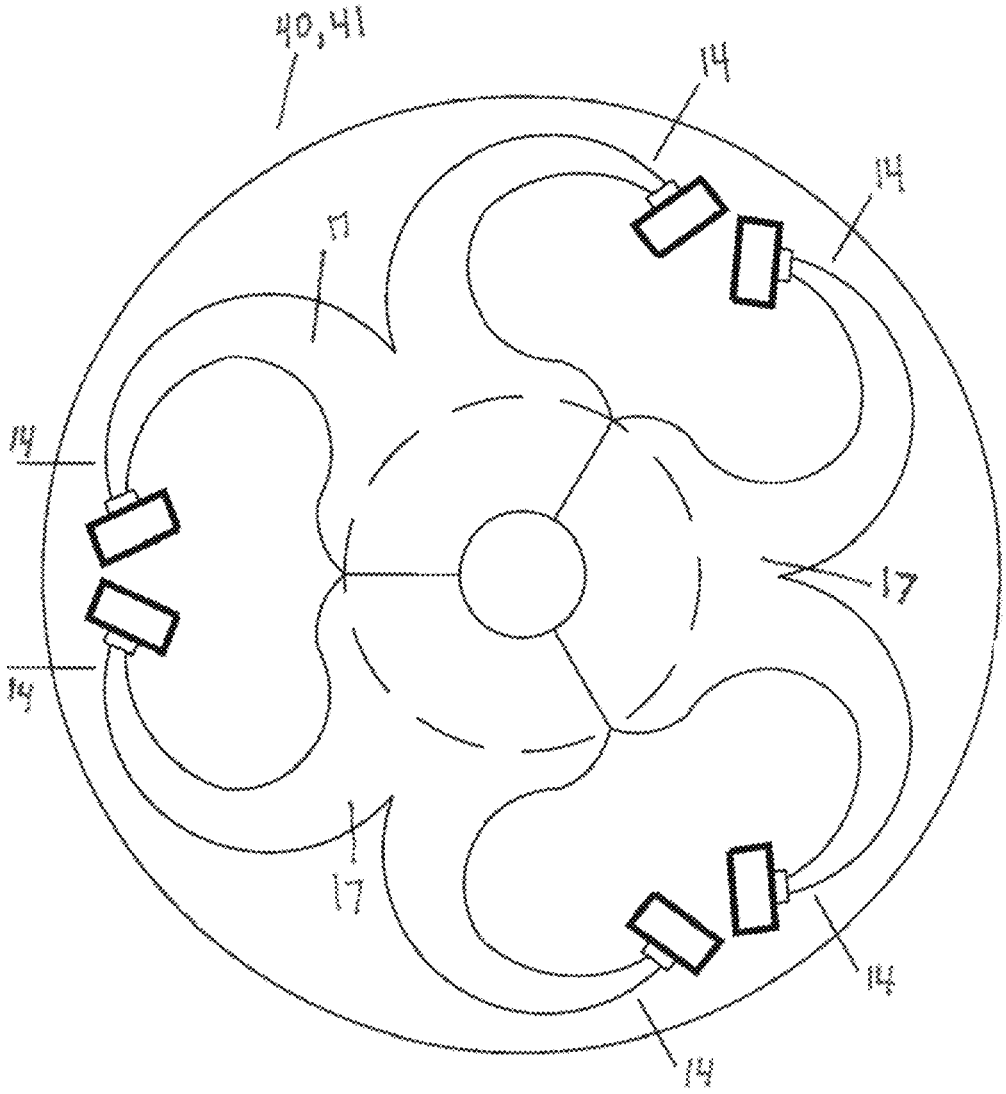
FIG. 8 is an omnidirectional siren is provided with one or more modules having three manifolds (or a third of an annulus (120 degrees)) and three, six or more drivers/compressors.

As an alternative design, FIG. 8 shows an omnidirectional siren is provided with one or more modules 40 or 41 having three manifolds 17 (or a third of an annulus (120 degrees)) and three, six or more drivers/compressors 14.

In certain embodiments of the invention as provided herein, a siren having a dual manifold design, where each manifold has double the cross-sectional area of other similar manifolds of the existing art, therefore increasing length of the waveguide, maintaining the exponential relationship of the horn from the mouth to the throat with no discontinuities, further enhances the product performance, due to a boost in the frequency response in the lower frequency range of 450-650 Hz, while minimizing wave distortion. This range of frequencies is the most effective for outdoor high-powered sirens to project perceivable sound over long distances of free air, as higher frequencies tend to attenuate faster. Also, better audio performance with regard to speech intelligibility can be obtained by using fewer audio sources (i.e. manifolds) with equivalent total power.

In another aspect of the invention, a 180 degrees siren in the shape of a half annulus or semi-circle is provided rather than an omnidirectional siren which may find particular utility when placed adjacent or along a vertical sided structure. In this instance a single manifold forming a half-annulus as described herein is fitted within each (one or more) hemi-circular adjacent modules to produce an exponentially increasing wavepath. One or more drivers/compressors to power the sound wave in each manifold as discussed herein may similarly be utilized.

It certain circumstances it may be beneficial to utilize modules having different manifold array configurations that deliver in-phase sound but in different directions at varying, strata, height, altitude, or direction such as providing an array with omnidirectional sound capability in one or more of the upper modules and merely 90, 180, 120, or 240 degrees (or simply less than 360 degrees) capability in one or more of the lower modules, or vice versa. For example, such configurations could limit the sound of the siren at the lower outside or external opening of a building or egress along a predetermined path and distance to be less than a more powerful upper omnidirectional siren output that would be heard at some distance from the structure. Accordingly, a building equipped with such a siren could emit a signal omnidirectionally and still provide a limited area of less intense sound along one or more routes closer or more distant to the siren.

The invention claimed is:

1. An omnidirectional siren comprising:

one or more vertically stacked modules;

first and second radially opposed manifolds housed within said module, said manifolds having equal cross-sectional area interior surfaces defining waveguides, said manifolds further having distal opposing half-annular openings operable to combine the sound emitted by the opposing half-annular opening;

two or more in-phase sound drivers coupled to a proximal throat portion of each said manifold; and a lower waveguide connected to the half-annular openings presenting a circumferential outlet that has an exponentially increasing surface area formed between an outer surface of said module and an adjacent opposing surface or module.

2. The siren in claim 1 wherein multiple modules are stacked upon one another and wherein a vertical dead space between said modules is between 1 inch and 5 inches.

3. The siren in claim 1 wherein multiple modules are stacked upon one another and wherein a vertical dead space between said modules is about 5 inches.

4. The siren in claim 1 wherein the audio sources are 100 watt compression drivers.

5. The siren in claim 1 further comprising adaptors such that four 100 watt drivers drive each waveguide thereby facilitating a total power per module of 800 watts.

6. The siren in claim 1 wherein each manifold is symmetrical and has double the cross-sectional area of a single manifold and is operable to maintain an exponential profile throughout the length of the horn with no discontinuities and operable to produce a sound wave signal in the frequency range of 450 Hz-650 Hz.

7. A method of producing an omnidirectional sound emission:

powering two or more in-phase audio source drivers connected to a first manifold at a first and second proximal throat producing a sound wave exiting said first manifold at a first distal half-annular opening;

powering two or more in-phase audio source drivers connected to a second manifold at a third and fourth proximal throat producing a sound wave exiting said second manifold at a second distal half-annular opening, wherein said first and second manifolds are radially opposed with respect each other and have inner surfaces forming waveguides of equal cross-sectional area that are exponentially expanding and continuous;

combining the sound waves emitted at the half-annular openings of the first and second manifolds and thereby doubling them and then redirecting said sound waves through an annular opening equal to the combined area of said hall-annular openings causing an omnidirectional sound emission from a circumferential mouth at a distal end of said annular opening.

8. A method of producing omnidirectional sound emission comprising;

powering one or more in-phase audio source drivers to create a first sound signal and directing the first sound signal into an exponentially expanding first waveguide;

powering one or more in-phase audio source drivers to create a second sound signal and directing the second sound signal into an exponentially expanding second waveguide;

causing the first and second waveguides to intersect and combine the first and second sound signals; directing the combined first and second sound signals into an exponentially expanding third waveguide;

powering one or more in-phase audio source drivers to create a third sound signal and directing the third sound signal into an exponentially expanding fourth waveguide;

powering one or more in-phase audio source drivers to create a fourth sound signal and directing the fourth sound signal into an exponentially expanding fifth waveguide;

causing the fourth and fifth waveguides to intersect and combine the third and fourth signals;

directing the combined third and fourth signals into an exponentially expanding sixth waveguide;

arranging the third and sixth waveguides such they are parallel and 180 degrees opposed to each other;

causing the third and sixth waveguides members to intersect and combine said first, second, third and fourth sound signals;

directing the combined sound signals into an exponentially expanding seventh waveguide that terminates in a circumferential opening thereby generating an omnidirectional sound emission.

* * * * *